US008215683B2

(12) United States Patent
Drescher et al.

(10) Patent No.: US 8,215,683 B2
(45) Date of Patent: Jul. 10, 2012

(54) CLOSING DEVICE, IN PARTICULAR FOR A COVER OF A MOTOR VEHICLE

(75) Inventors: Michael Drescher, Enkering (DE); Gunther C. Bohm, Walting (DE)

(73) Assignee: Audi AG, Ingolstadt (DE)

( * ) Notice: Subject to any disclaimer, the term of this patent is extended or adjusted under 35 U.S.C. 154(b) by 660 days.

(21) Appl. No.: 11/723,131

(22) Filed: Mar. 16, 2007

(65) Prior Publication Data

US 2007/0216170 A1 Sep. 20, 2007

(30) Foreign Application Priority Data

Mar. 16, 2006 (DE) ..... 10 2006 012 062

(51) Int. Cl.
*E05C 3/06* (2006.01)

(52) U.S. Cl. ..... 292/216; 292/201; 292/DIG. 23

(58) Field of Classification Search ..... 292/216, 292/201, DIG. 23
See application file for complete search history.

(56) References Cited

U.S. PATENT DOCUMENTS 3,851,905 A * 12/1974 Klebba ..... 292/11
4,886,307 A * 12/1989 Ruckert ..... 292/216

FOREIGN PATENT DOCUMENTS

| | | |
|---|---|---|
| DE | 882274 | 11/1961 |
| DE | 37 13 100 | 11/1988 |
| DE | 199 26 386 | 3/2000 |
| DE | 100 18 194 | 10/2001 |
| DE | 101 48 639 | 5/2002 |
| DE | 101 04 053 | 8/2002 |
| DE | 101 43 263 | 5/2003 |
| DE | 102 24 076 | 12/2003 |
| DE | 100 46 189 | 4/2004 |
| EP | 0 969 170 | 1/2000 |
| FR | 2876811 | 10/2004 |
| GB | 882274 | 11/1961 |
| WO | WO 9400703 A1 | 1/1994 |

* cited by examiner

*Primary Examiner* — Carlos Lugo
*Assistant Examiner* — Mark Williams
(74) *Attorney, Agent, or Firm* — Novak Druce + Quigg LLP

(57) ABSTRACT

The invention relates to a closing device, in particular for a cover of a motor vehicle, having a rotary latch which interacts with a cover-side locking clamp (10) and which is held securely in its closed position by means of a pawl, and with a catch hook (20) which can be caused to engage the catch element (42) after transfer of the pawl into the open position and by which the cover is to be kept in the holding position, and the catch hook (20) can be transferred out of the holding position into the open position in which the cover is to be completely opened, the rotary latch and the catch hook (20) being made as separate parts, and the pawl of the rotary latch and the catch hook (20) is to be actuated in a sequence via a common remote actuation element (Bowden cable 24) after one another.

8 Claims, 3 Drawing Sheets

CLOSING DEVICE, IN PARTICULAR FOR A COVER OF A MOTOR VEHICLE

The invention relates to a closing device for a cover of a motor vehicle.

BACKGROUND OF THE INVENTION

Such a closing device has already been disclosed in DE 101 48 639 A 1; a front hood is to be fixed by way of the closing device on the front structure of the vehicle body. For this purpose the closing device has a rotary latch which interacts with a cover-side locking clamp and which is held securely in its closed position by means of a spring-loaded pawl. To open the hood the pawl can be transferred against the spring force of the spring element to a release position, after which the pawl which has likewise been pretensioned via a spring element is to be moved into an open position. By means of a lock ejection spring the locking clamp and the entire hood is to be transferred to a holding position which is elevated relative to the front structure until a catch hook assigned here to the pawl engages the locking clamp which is used here as the catch element. This holding position of the catch hook and hood ensures that it does not completely open when the closing device is unintentionally actuated, but rather simply by a small vertical amount relative to the front structure. When the hood is intentionally opened conversely the catch hook must be transferred manually out of the holding position into the open position in which the locking clamp is released in order to thus open the hood completely.

The disadvantage in this known closing device is considered to be the circumstance that the catch hook as part of the pawl can only be transferred into its open position by an operator effecting manual intervention from the front, with the vehicle stopped.

The object of this invention is therefore to improve a closing device of the initially mentioned type such that it can be used in a more versatile manner.

SUMMARY OF THE INVENTION

According to the invention, the closing device intended for this purpose comprises a rotary latch and catch hook which are made as separate parts, and the pawl of the rotary latch and the catch hook are to be actuated in succession via a common remote actuation element, for example in the form of a Bowden cable, in a sequence. In other words, it is easily possible in this way under certain circumstances which will be described below in particular, to operate the catch hook via the same remote actuation element with which the pawl of the rotary latch is to be moved into a releasing open position. Thus the closing device according to the invention enables the emergency release on the catch hook lever 44 of the cover for example of a trunk which is closed or covered by it on the front end of the vehicle. This yields an especially simple configuration of the closing device based on the fact that the same remote actuation element, for example in the form of a Bowden cable, can be used both for unlocking the pawl of the rotary latch and also for transferring the catch hook into its open position.

A remote actuation element made as a Bowden cable, with its cord connected to the pawl and with its jacket connected to the catch hook, offers a simple and reliable possibility for actuating the pawl and the catch hook in chronological sequence after one another. If the jacket of the cord is supported on the lever of the catch hook, the relative motion of the cord compared to the jacket of the Bowden cable can be easily used to transfer the catch hook out of the holding position into the open position. The sequence of actuation of first the pawl of the rotary latch and then of the catch hook can be ensured very easily by the actuating force of the pawl being made smaller than that of the catch hook lever. Thus the sequence of actuating the pawl and then the catch hook lever can be easily implemented by first of all, due to the higher actuating force, the jacket of the Bowden cable being held stationary on the catch hook, while its cord which is connected to the pawl, due to the lower actuating force, is to be moved relative to the jacket and the catch hook. After the pawl has been transferred into its open position by the motion of the cord, in a second step the jacket can be moved relative to the cord and accordingly the catch hook is transferred into its open position. An especially defined open position of the pawl can be easily implemented by an end stop on which the pawl can be supported, after which the cord is secured in place. Further actuation of the Bowden cable leads conversely to the movement of the jacket which is desired according to the invention relative to the cord of the Bowden cable. Thus in a second step the jacket is pushed relative to the then stationary cord such that the catch hook lever transfers the catch hook into its open position.

The cord should optionally be able to be moved relative to the jacket which is held stationary by the catch hook lever in order to release the pawl, but subsequently it should not be possible to move the jacket relative to the then stationary cord which would then lead to transfer of the catch hook into the open position. This can be the case for example when the driving speed of the vehicle is too high, and accordingly opening of the pawl is desirable, but not opening of the catch hook. Therefore in another embodiment of the invention it is advantageously shown that a blocking means be provided with which actuation of the catch hook can be stopped depending on the driving speed of the vehicle.

This actuation of the catch hook can be especially easily stopped by the blocking means stopping the movement of the jacket relative to the cord in the second step. If conversely within the front trunk of a vehicle for example there is an emergency release, depending on the driving speed either the pawl and the catch hook or simply the pawl can be released, the catch hook then remaining in its holding position.

Versatile use of the closing device according to the invention can also be implemented especially in that in addition to the remote actuation element for the emergency release of the closing device from a front trunk, there is another remote actuation means with which the pawl of the rotary latch is to be transferred into its open position. This further remote actuation means can be activated for example via a remote control button on the vehicle lock or a button in the vehicle interior. In this connection the catch hook can be located within the closing device such that it is to be transferred manually out of the holding position into the Open position independently of the remote actuation element.

Finally, an especially simple closing device can be achieved by both the pawl of the rotary latch and the catch hook after actuation by means of the remote actuation element automatically traveling back into its closed position or holding position.

DETAILED DESCRIPTION OF THE PREFERRED EMBODIMENTS OF THE INVENTION

Figure 1:
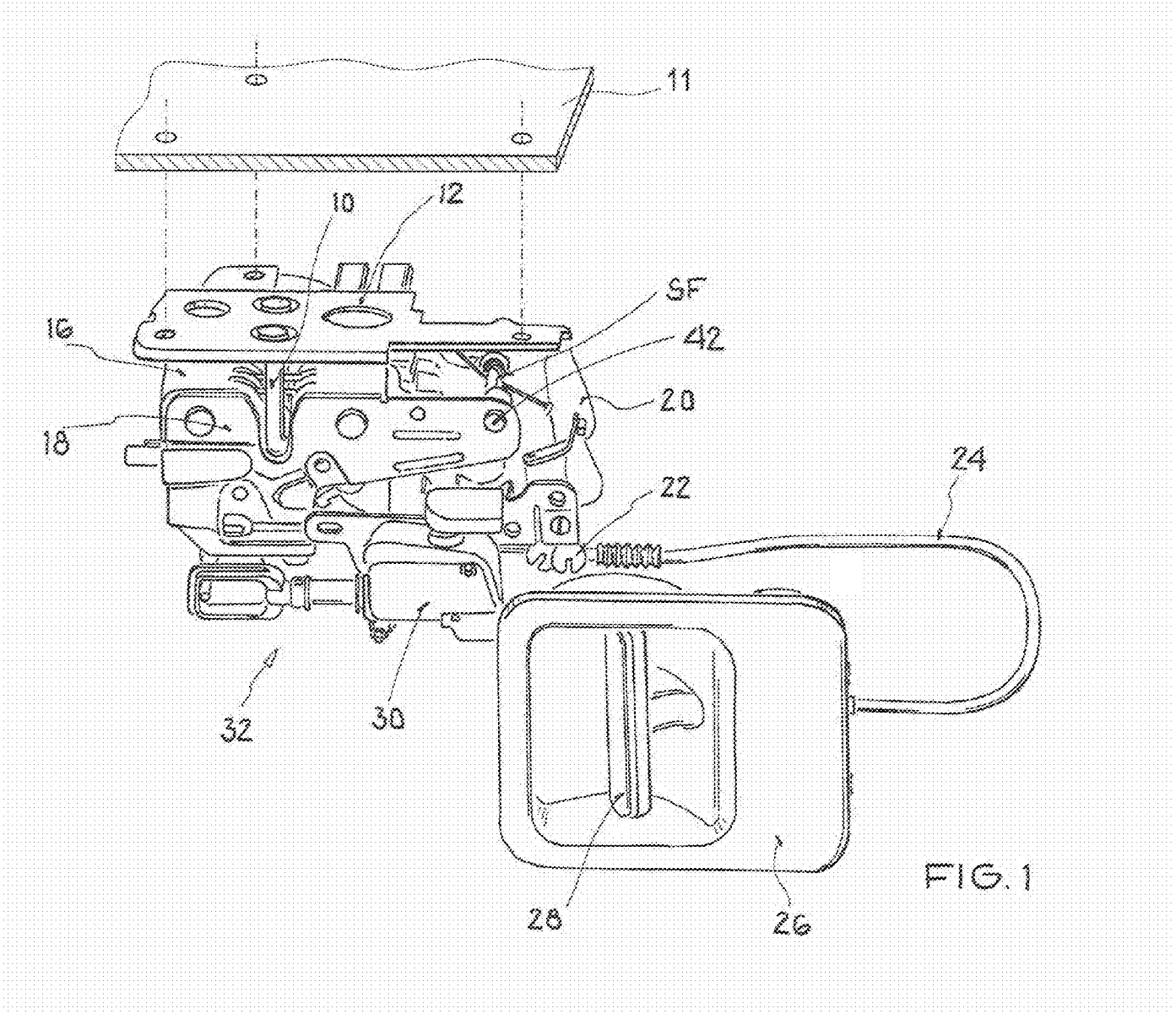
FIG. 1 shows a schematic and slightly perspective front view of the closing device according to the invention, in which in particular a remote actuation element in the form of a Bowden cable is to be seen, with which on the one hand a pawl located hidden within the housing, that is the pawl of a rotary latch likewise located within the housing, and on the other hand the lever of a catch hook located laterally from the rotary latch, are to be actuated, on the top of the closing device a cover-side locking clamp for interaction with the rotary latch being recognizable.

FIG. 1 shows in a schematic and slightly perspective front view the closing device with which a cover 11 for closing a trunk can be fixed on the front end of a vehicle on the vehicle body. The closing device comprises an essentially U-shaped locking clamp 10 which is to be fixed via a locking clamp plate 12 on the bottom of the front end of the cover for example by screw connections. The cover 11 and the locking clamp 10 which is permanently connected to it is to be fixed on the vehicle body via a rotary latch 14 (FIG. 2) which will be detailed below especially with reference to FIG. 2 and which is located in FIG. 1 within a housing 1 which holds it and therefore is essentially not recognizable. The housing 16 is fixed via a mounting plate 18 securely on a cross bridge on the front end of the front structure of the vehicle body.

Furthermore the closing device comprises a catch hook 20 which is made separately from the rotary latch 14, said catch hook being supported on the locking clamp plate 12 so as to be able to pivot: around a pivoting axis SF, and mounted laterally from the housing 16 of the rotary latch 14. The catch hook 20 can be actuated via a catch hook lever 22 which is shown in FIG. 1 in its two end positions and is detailed especially with reference to FIG. 3.

Both the rotary latch 14 and also the catch hook lever 22 of the catch hook 20 are to be actuated via a common remote actuation element in the form of a Bowden cable 24, on the end of which facing the pawl 14 and the catch hook lever 22 there is a handle 28 held within the housing 26. The housing 26 with the handle 28 is held within the trunk lining on the front end of the vehicle and is used for an emergency release of the lid from the trunk in a manner which will be detailed below.

Moreover, in FIG. 1 there is a positioning element 30 of another remote actuation means 32 via which the rotary latch 14 in a manner still to be detailed is to be unlocked by means of a remote control button for unlocking the trunk on the vehicle key or by means of a button within the vehicle.

Figure 2:
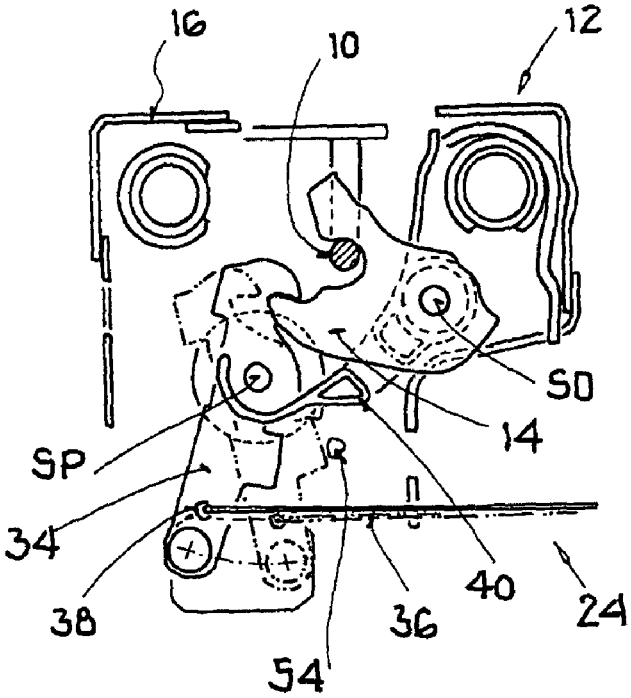
FIG. 2 shows a schematic sectional view through the closing device as shown in FIG. 1, in particular actuation of the pawl of the rotary latch by means of the Bowden cable becoming apparent.

FIG. 2 shows in an extract sectional view the housing 16 of the closing device in a schematic sectional view. In this connection the rotary latch 14 is held pivoted around a pivoting axis SD within the housing 16. The rotary latch 14 is shown here in its closed position in which it keeps the locking clamp 10 and thus the cover secured in the closed position. The rotary latch 14 in turn is held by means of a pawl 34 in its closed position which is mounted supported around a pivoting axis SP within the housing 16. If the pawl 34 is transferred out of its closed position shown by solid lines into the released or open position shown by a dot-dash line, the rotary latch 14 travels out of its closed position shown here, supported by the spring force of a spring element, into the open position which releases the locking clamp 10. By means of a lock ejection spring which is not shown then the cover and the locking clamp 10 are moved up.

Transfer of the pawl 34 out of the locking or closed position is shown by the solid line into its released or open position indicated with the dot-dash line is effected by means of the cord 36 of the Bowden cable 24 which in the region of a mounting opening 38 acts on the pawl 34. When the pawl 34 is moved out of its closed position into its open position, a spring element 40 is pretensioned via which the pawl 34 after the closing process travels back into its closed position with the cord 36 accordingly untensioned.

Figure 3:
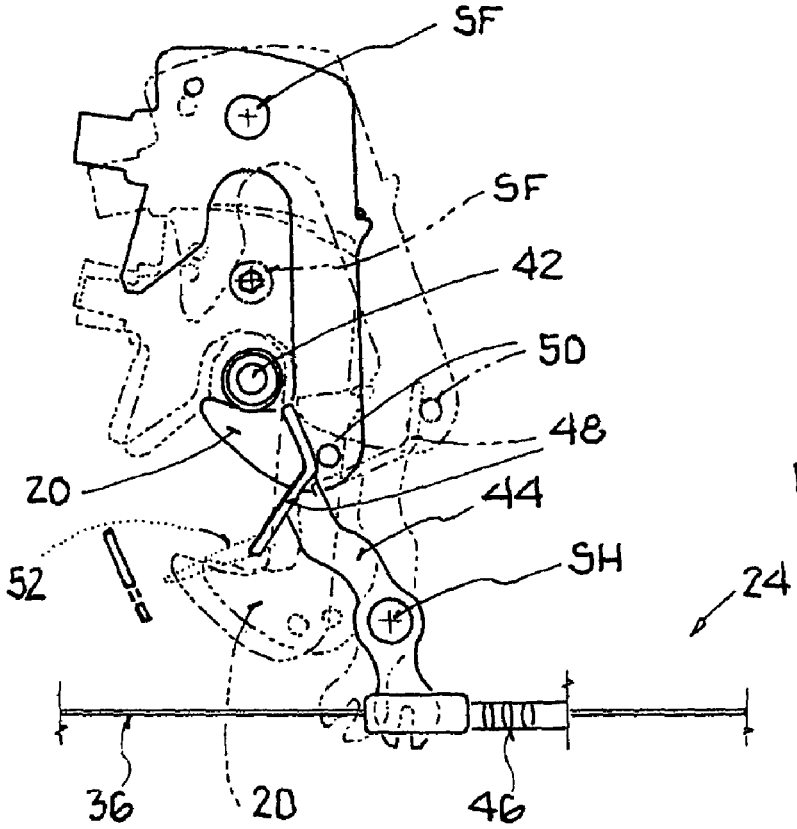
FIG. 3 likewise shows a schematic sectional view through the closing device as shown in FIG. 1, actuation of the catch hook by means of the Bowden cable being explained.

FIG. 3 shows in another schematic sectional view that region of the closing device in which the catch hook 20 is housed. The catch hook 20 is shown here in two bottom positions which it assumes when the rotary latch 14 is closed and accordingly the locking clamp 10 and the cover are fixed in their closed position on the vehicle body. Moreover the catch hook 20 is to be seen in two top positions which it assumes when the rotary latch 14 is already unlocked and accordingly the locking clamp 10 is no longer engaged to it. Depending on whether the catch hook 20 is in the top or bottom position, its pivoting axis SF also drifts accordingly.

If the pawl 34 is actuated accordingly by means of the cord 36 of the Bowden cable 24 and the rotary latch 14 travels accordingly into its open position, the catch hook 20 drifts out of its lower position shown in FIG. 3 into a top holding position in which it engages the catch element 42 which is located on the body side on the mounting plate 18 in the form of a pin. In this way the cover is fixed in a holding position in the vertical region above its closed position, after transfer of the rotary latch 14 into its open position by means of the catch hook 20 which interacts with the catch element 42.

In order to transfer the catch hook 20 out of its holding position which engages the catch element 42, shown by the solid lines, into its open position shown by the dot-dash line, in which the catch hook 20 is no longer engaged with the catch element 42, a catch hook lever 44 must be actuated which for its part is pivoted around a pivoting axis SH. On its side facing away from the catch hook 20, the tube mount or jacket 46 of the Bowden cable 24 is supported on the catch hook lever 44. Proceeding from the catch hook lever 44 then the cord 36 of the Bowden cable 24 runs toward the pawl 34. If the catch hook lever 44 is transferred in a manner to be detailed below by means of the jacket 46 out of the closed position shown by the solid line into an open position shown by the dot-dash line, in this way the catch hook 20 is likewise transferred out of its upper holding position which is engaged with the catch element 42 into the open, disengaged position. For this purpose, on the end of the catch hook lever 44 which faces away from the jacket 46 a guide part 48 is attached which interacts with a laterally projecting pin 50 on the catch hook 20. With the corresponding actuation of the catch hook lever 44 conversely the catch hook 20 is transferred via the pin 50 out of the holding position into the open position. On the catch hook lever 44 with one end a spring element 52 is attached which is pretensioned when the catch hook lever 44 is transferred out of its closed position shown by the solid lines into the open position which is shown by the dot-dash line.

Figure 4:
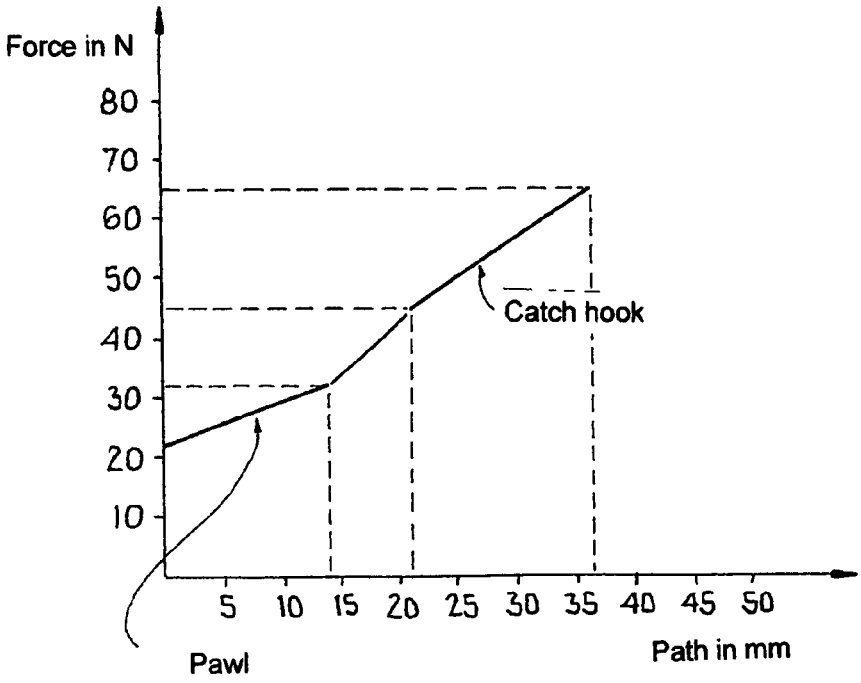
FIG. 4 shows a schematic diagram of the actuating forces of the pawl and of the catch hook which must be applied to transfer them into their respective open position.

FIG. 4 shows a diagram which is intended to illustrate how the spring force of the spring element 40 of the pawl 34 is designed relative to the spring force of the spring element 52 of the catch hook lever 44. Here it is to be seen that the actuating force or spring force of the pawl 34 is in the range between 20 and 30 N and the actuating force or spring force of the catch hook 20 and of the catch hook lever 44 in the range from 45 to 65 N. In other words, the actuating force of the pawl 44 thus is designed to be much less than the actuating force of the catch hook lever 44 and the catch hook 20. The actuating force of the pawl 34 and of the catch hook 20 is shown in FIG. 4 relative to the path in millimeters which is applied by the Bowden cable 24 to the pawl 34 and the catch hook 20.

If accordingly the Bowden cable 24 is actuated by means of a handle 28, the two spring elements 40 and 52 are designed such that first of all based on the low actuating force the pawl 34 is transferred by means of the cord 36 of the Bowden cable 24 out of its closed position shown in FIG. 2 with the solid line into the open position shown by the dot-dash line, the catch hook 20 and its lever 44 remaining in their holding position. Accordingly the jacket 46 of the Bowden cable 24 is supported stationary on the catch hook lever 44 based on the higher actuating force of the spring element 52, while the pawl 34 is transferred out of the closed position into its open position.

Since the pawl 34 has been pivoted into its open position, it is supported after actuation with the cord 36 on its end stop 54, so that the cord 36 of the Bowden cable 24 is now secured to be stationary. As is to be seen in FIG. 4, the pawl 34 after a path of approximately 14 mm of the cord 36 of the Bowden cable 24 has reached its open position. The actuation of the Bowden cable 24 leads essentially to action on its jacket 46, since its cord 36, as explained above, is located secured by the pawl 34 in its stationary position. Thus the jacket 46 is moved relative to the cord 36 of the Bowden cable 24. Since the cord 36 is held stationary, accordingly the catch hook lever 44 which is exposed to the higher actuation force of the spring element 52 is pivoted out of its closed or holding position shown by the solid line into the open position shown by the dot-dash line. As is to be seen in FIG. 4, the pivoting of the catch hook lever 44 and of the catch hook 20 is effected for a path of the Bowden cable 24 of approximately 21 to 36 mm.

As is apparent from looking at FIGS. 2 to 4 together, remote actuation of the pawl 34 and of the catch hook lever 44 and of the catch hook 20 is effected accordingly in a sequence which is dictated by the different actuating forces of the spring element 40 and 52 of the pawl 34 and of the catch hook lever 44. In this sequence accordingly first the pawl 34 is moved by means of the cord 36 in that the jacket 46 is held stationary on the catch hook lever 44. After the pawl 34 has reached its open position which holds the cord 36 stationary, in the second step of the sequence the jacket 46 of the Bowden cable 24 is moved relative to the cord 36. This yields the desired sequence according to the invention, that is first of all the opening of the rotary latch 14 and then the transfer of the catch hook 20 out of its holding position into a release position disengaged from the catch element 42. In other words, it is possible according to the invention from the trunk on the front end of the vehicle by means of the handle 28, under certain circumstances to be detailed below, first of all to transfer the rotary latch 14 and then the catch hook 20 into a open position, so that an individual trapped within the trunk can escape from the vehicle and the trunk.

Figure 5:
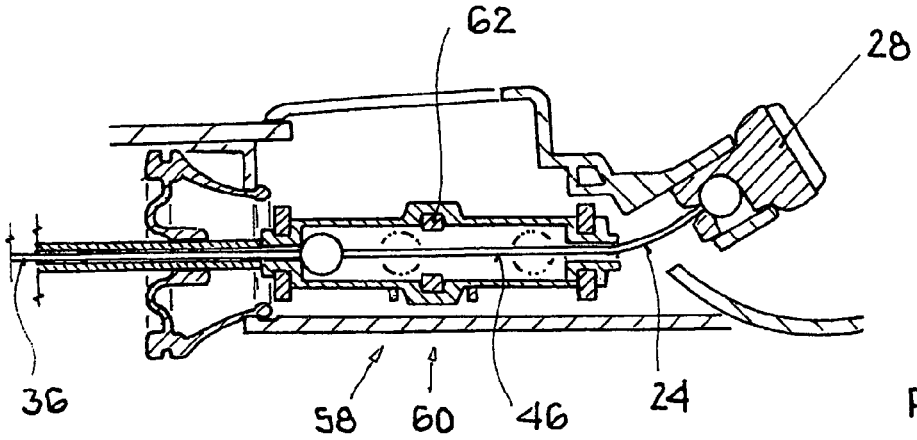
FIG. 5 shows a schematic section view through the remote actuation element in the form of the Bowden cable, with a jacket which can be held stationary by a blocking means.

FIG. 5 finally shows in a schematic sectional view a blocking means 58 which is located between the handle 28 and the catch hook lever 44 and which is switched depending on the driving speed of the vehicle. The blocking means 58 consists in this embodiment of an electromagnet which is energized or not depending on the driving speed of the vehicle. If conversely the handle 28 is actuated from the trunk, first of all in the process shown in FIG. 2 the pawl 34 is transferred by a corresponding motion of the cord 36 relative to the jacket 46 out of the closed position into the open position. Thus the catch hook 20 engages the pertinent catch element 42, with the cover of the vehicle being held by the catch hook 20 in its holding position. If at this point the driving speed of the vehicle is above 5 km/h, the cover should not be able to be opened further by means of the handle 28 beyond its holding position held by the catch hook 20. In this case the electromagnet of the blocking means 58 is energized so that the blocking clamp 60 of the blocking means 58 stops the motion of the jacket 46 relative to the cord 36. The blocking clamp 60 here for example comprises two holding jaws 62 which prevent motion of the jacket 46. Thus, the motion of the jacket 46 relative to the cord 36 which is explained with reference to FIG. 3 is made impossible so that the catch hook lever 44 and the catch hook 22 cannot be moved into their open position, but rather the catch hook 20 remains engaged with the catch element 42. This results in that at speeds above 5 km/h the cover cannot be completely opened by means of the handle 28 from the trunk, but rather remains in the holding position caused by way of the catch hook 20.

If the driving speed of the vehicle conversely is less than 5 km/h, the electromagnet of the blocking means 58 is not energized and the blocking clamp 60 does not stop motion of the jacket 46 of the Bowden cable 24. Thus, at driving speeds less than 5 km/h the movement of the jacket 46 explained with reference to FIG. 3 relative to the cord 36 is allowed so that the catch hook 20 travels out of its holding position engaged to the catch element 42 into its open position in which the lid for closing the trunk can be completely opened. This takes place based on the fact that complete opening of the lid by means of the handle 28 from the trunk is not critical at driving speeds below 5 km/h.

In addition to actuation by means of the handle 28 of the Bowden cable 24, the pawl 34 and the rotary latch 14 is also to be opened in the conventional manner by means of the positioning element 30 which is to be actuated for example via a remote control button on the vehicle key or a button within the vehicle. The holding position of the catch hook 20 can then be cancelled by means of a handle with the vehicle stationary or the catch hook 20 can be transferred into the open position so that the trunk becomes accessible on the front end of the vehicle.

After actuating the pawl 34 and the catch hook element 44 and the catch hook 20 by means of the Bowden cable 24, they travel automatically back into their closed position or holding position.

The invention claimed is:

1. A mechanism for releasably retaining a cover member of a motor vehicle, comprising:

a first rotary latch mounted on the body of said vehicle rotationally, biased in a first direction into latching engagement with a first component of said cover;

a first rotary pawl mounted on said body rotationally, biased in a first direction into obstructing engagement with said first rotary latch when said first rotary latch engages said first component to thereby releasably retain said first latch in a first latch state;

a second rotary latch mounted on said cover member having a portion engageable in hooking engagement with a second component of said cover for releasably retaining said cover in a partially open position when said first rotary latch is rotatably released;

a second rotary pawl mounted on said body engageable with said second rotary second latch when said second rotary latch portion is disposed in hooking engagement with said second component of said body to thereby releasably retain said second rotary latch in a first latch state; and means operable to successively rotate said first pawl to rotate said first rotary latch in a second direction out of said first latch state thereof to release said first component and allow said cover to partially open and rotate said second pawl to rotate said second rotary latch out of said first latch state thereof to release said cover from said second component.

2. A mechanism according to claim 1 wherein said release means includes a cable connected to said first rotary pawl which may be drawn to rotate said first pawl and thus release said first latch, and having means engageable with said second pawl at an interval subsequent to the release of said first latch, to release said second latch.

3. A mechanism according to claim 2 wherein said cable is a Bowden cable provided with a handle.

4. A mechanism according to claim 1 wherein the force required to actuate said first pawl is less than the force required to actuate said second pawl.

5. A mechanism according to claim 1 including means for disabling actuation of said second latch responsive to a selected speed of said vehicle.

6. A mechanism according to claim 1 including an emergency release of said mechanism disposed in a front trunk of said vehicle, and the actuating means of said release means is disposed in the interior of said vehicle.

7. A mechanism according to claim 1 wherein said second latch may be released manually.

8. A mechanism according to claim 1 wherein said latches are caused to be restored to their latching conditions upon deactivization of said release means.

* * * * *

UNITED STATES PATENT AND TRADEMARK OFFICE

CERTIFICATE OF CORRECTION

PATENT NO. : 8,215,683 B2
APPLICATION NO. : 11/723131
DATED : July 10, 2012
INVENTOR(S) : Drescher et al.

It is certified that error appears in the above-identified patent and that said Letters Patent is hereby corrected as shown below:

On the Title page: Item (75) Inventors:

The second named inventor should be Günther Böhm.

Signed and Sealed this
Eighteenth Day of September, 2012

David J. Kappos

David J. Kappos
*Director of the United States Patent and Trademark Office*